US005363932A

United States Patent [19]

Azar

[11] Patent Number: 5,363,932

[45] Date of Patent: Nov. 15, 1994

[54] PDC DRAG BIT WITH IMPROVED HYDRAULICS

[75] Inventor: Michael G. Azar, Houston, Tex.

[73] Assignee: Smith International, Inc., Houston, Tex.

[21] Appl. No.: 59,922

[22] Filed: May 10, 1993

[51] Int. Cl.[5] ..... E21B 10/60

[52] U.S. Cl. ..... 175/417; 175/429

[58] Field of Search ..... 175/417, 429, 393, 394

[56] References Cited

U.S. PATENT DOCUMENTS

| | | | |
|---|---|---|---|
| 4,606,418 | 8/1986 | Thompson | 175/429 |
| 4,667,756 | 5/1987 | King et al. | 175/417 X |
| 4,676,324 | 6/1987 | Barr et al. | 175/393 |
| 4,733,735 | 3/1988 | Barr et al. | 175/393 |
| 4,776,411 | 10/1988 | Jones | 175/393 |
| 4,794,994 | 1/1989 | Deane et al. | 175/429 |
| 4,848,489 | 7/1989 | Deane | 175/429 |
| 4,883,132 | 11/1989 | Tibbitts | 175/393 X |
| 5,033,560 | 7/1991 | Sawyer et al. | 175/417 X |

*Primary Examiner*—Michael Powell Buiz
*Assistant Examiner*—Frank S. Tsay
*Attorney, Agent, or Firm*—Robert G. Upton

[57] ABSTRACT

A drag bit for soft, sticky formations is disclosed with a new fluid dynamics control mechanism that minimizes "bit-balling". Multiple blades carrying PDC cutters have tapered back sides to achieve greater velocity through the fluid channels. Multiple jet nozzles in each fluid channel create interacting vortices that produce extremely turbulent flow thereby minimizing the coagulation and deposition of the hydrated clay cuttings on the bit cutting surfaces.

6 Claims, 3 Drawing Sheets

PDC DRAG BIT WITH IMPROVED HYDRAULICS

BACKGROUND OF THE INVENTION

1. Field of the Invention

The present invention relates to diamond drag bits.

More particularly, this invention relates to polycrystalline diamond compact (PDC) drag bits for drilling soft, sticky clay and shale earthen formations.

2. Description of the Prior Art

Earthen formations, such as bentonitic shales and other hydratable clays, that are plastic and sticky, are very difficult to drill because the drilled cuttings tend to coagulate and adhere to or "ball-up" the cutting face of the drill bit. This drastically reduces the drilling rate and bit life.

Roller cone drill bits and tungsten carbide "fish-tail" drag type drill bits have had limited success when attempting to drill these formations with water base muds. Both bit types "ball-up" very easily, severely slowing or stopping the drilling rate. This results in having to make numerous costly trips of the drill string to change bits.

Natural diamond drill bits also have had limited success drilling these sticky formations because they are very easily "balled-up" due to the extremely small protrusion of the diamond cutting elements.

PDC type drag bits in present use are very effective drilling soft, hydratable shales and clays when using oil base drilling mud, but severely "ball-up" when using water base drilling muds which hydrate the formations which made them sticky.

State of the art PDC drill bits for drilling soft formations are multiple bladed with PDC cutters affixed to the outer surfaces of the blades. The aforesaid blades have a leading side and a trailing side which are essentially vertical and parallel to the tilt axis. A single nozzle is positioned in relatively close proximity to the bit center and in the center of a fluid channel formed by two of the blades. The drilling fluid exiting the nozzle naturally flows radially at high velocity to the outer diameter of the bit close to the center line of the fluid channel. This creates low fluid pressure areas proximate the leading and trailing sides of adjacent blades, thereby inducing reverse flow of drilling fluid and entrained hydrated drill cuttings close to the blades. The hydrated drill cuttings now have an affinity for the metal bit head surface because of their electrical charge, therefore they aggregate and adhere to the bit head surface behind the trailing side of the aforesaid preceding blade. The rotation of the bit while drilling also causes a differential pressure between the leading and trailing sides of the blades amplifying the adherence of the drill cuttings to and subsequent balling of the bit head.

A new fluid dynamics control mechanism is disclosed which overcomes the inadequacies of the prior art. This new control can be adapted to the basic blade type bits presently in use.

SUMMARY OF THE INVENTION

It is an object of the present invention to eliminate or minimize sticky clay or shale drill cuttings from preferentially adhering to and "balling-up" a polycrystalline compact (PDC) drag type drill bit cutting face while drilling in a bore hole.

More specifically, it is an object of the present invention to provide a PDC drag bit having at least two jet nozzles or ports that discharge drilling fluid at high velocity into each of a multiplicity of essentially radial channels that are formed by an equal number of raised radial lands or blades formed on the bit head surfaces. An array of PDC cutters are strategically affixed on the outer surfaces of the blades. The volume and velocity of the drilling fluid in all of the channels, at their exits at the bit head outer diameter, are essentially equal.

The drag type drilling bit of the present invention consists of a bit body that forms a first pin end and a second cutting end. The cutting end may be made from steel or other material such as tungsten carbide matrix. The pin end is opened to a source of drilling fluid that is transmitted through an attachable drillstring. The pin end communicates with a fluid chamber that is formed in the bit body. Two or more raised lands or blades which form a first leading side and a second trailing side, are disposed radially on the cutting end of the bit. A multiplicity of PDC cutting elements are strategically mounted on the blades. Drilling fluid channels are formed between the blades that originate proximate the bit head center and terminate at the bit outer diameter. Two or more fluid discharge ports or nozzles, whose center lines are parallel to the leading edge of the blade, communicate with the aforesaid fluid chamber and exit into each fluid channel in close proximity to the leading edge or side of each blade. The vortices created by the drilling fluid exiting the multiple jet nozzles, in each fluid channel, inter-act to produce a highly turbulent radial flow to clean and cool the bit head surface and cutting elements. The leading side of each blade is essentially vertical and parallel to the bit axis. The trailing side of each blade tapors back from a crest forming a plane that intersects the root of the following blade, creating a more uniform fluid flow area in each channel. The trailing taper on the blade minimizes the low pressure area that is normally present on the trailing side of the straight backed bladed bits presently in use.

An advantage then over the prior art is the means in which a highly turbulent radial flow of drilling fluid is created proximate the leading side of the blades and PDC cutters by the jet nozzles in each blade. This highly turbulent flow efficiently cleans and cools the PDC cutters and the bit head surfaces on the leading side of the blades.

Another advantage over the prior art is that the tapered trailing side of each blade eliminates the low pressure area immediately behind each blade thereby reducing or eliminating reverse fluid flow and the packing of sticky clay drill cuttings on the bit head and blade trailing side surfaces. This eliminates or minimizes "bit balling" which normally leads to slow drilling rates or bit run termination.

Yet another advantage over prior art is that the tapered trailing side on the blades adds considerable strength to the blades needed when used under severe drilling conditions.

The above noted objects and advantages of the present invention will be more fully understood upon study of the following description in conjunction with the detailed drawings.

DESCRIPTION OF THE PREFERRED EMBODIMENTS AND BEST MODE FOR CARRYING OUT THE INVENTION

Figure 1:
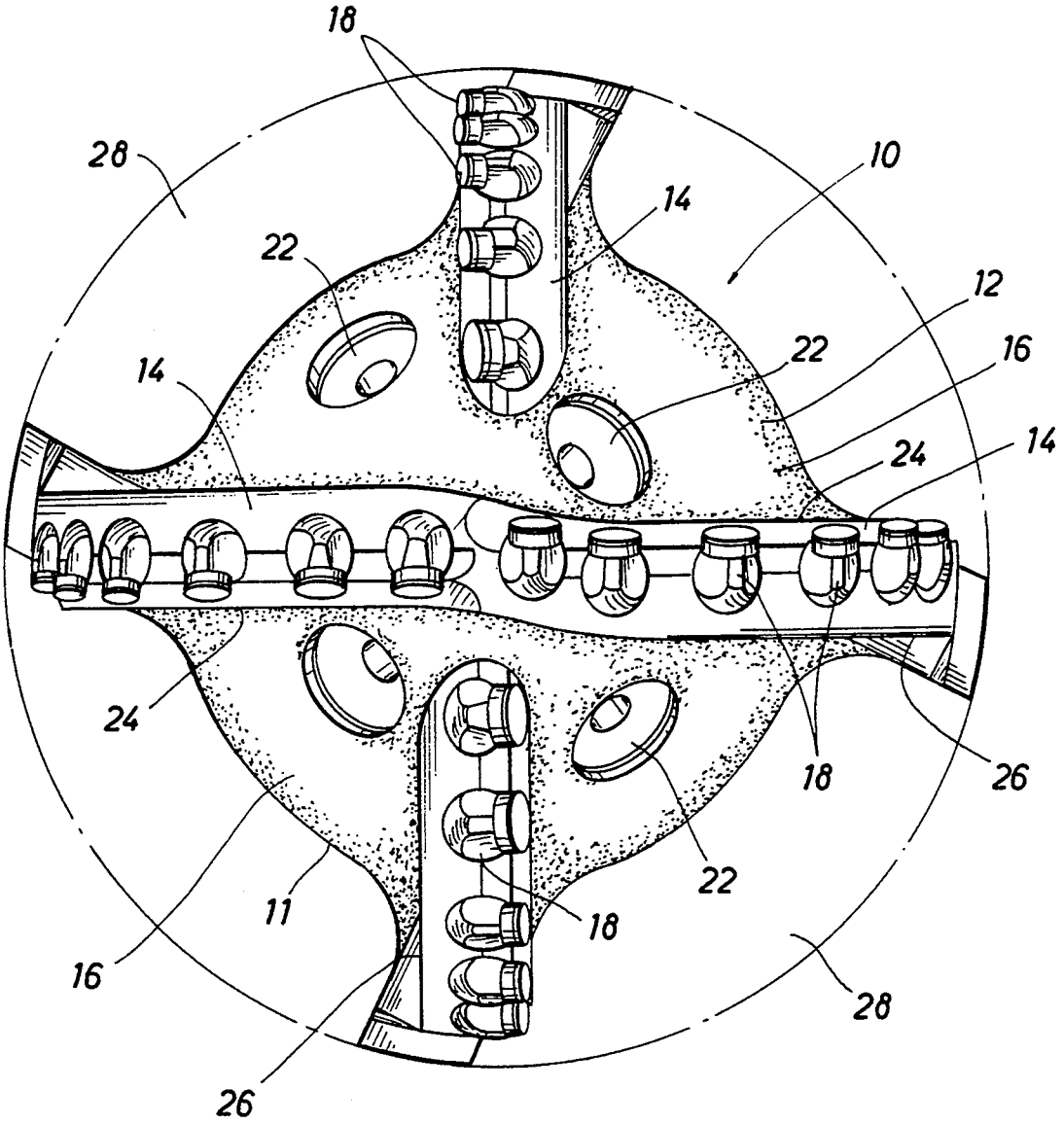
FIG. 1 is a face view of the cutting head of a typical prior art PDC drag bit for use in drilling soft sticky shales and clay formations.

With reference to the face view of FIG. 1, a typical prior art PDC drag bit, generally designated as 10, consists of a drag bit body 11 having an open threaded pin end (not shown), a cutting end 12, raised radial vertical sided blades or lands 14 with fluid channels 16 formed therebetween. An array of PDC cutters 18 are affixed to the outer surface of blade 14. A fluid nozzle or port 22, which communicates with a fluid plenum (not shown) in bit body 11, is positioned equidistantly between each leading edge 24 of blade 14 and each trailing edge 26 of the preceding blade 14. With the nozzle 22 so positioned between two straight sided blades 14, the drilling fluid exits the nozzle and dumps radially through the center of the fluid channel 16 creating low pressure areas at or close to both the leading blade edge 24 and the preceding blade back edge 26. The fluid velocity in the fluid channel 6 being a direct function of the volume pumped and the cross-sectional area through which it is pumped is, for example, in the range of 250 ft/sec to 450 ft/sec exiting the nozzle 22. The fluid velocity decreases very rapidly as it flows outwardly through the fluid channel 16 to a velocity approximately 3 ft/sec to 6 ft/sec in the outer bit diameter relief slot 28. This low fluid velocity allows the sticky drill cuttings to agglomerate and adhere to both the leading blade edge 24, the trailing blade edge 26 and other portions of the bit cutting face 48, thereby creating a condition conducive to "balling-up" the bit.

Figure 2:
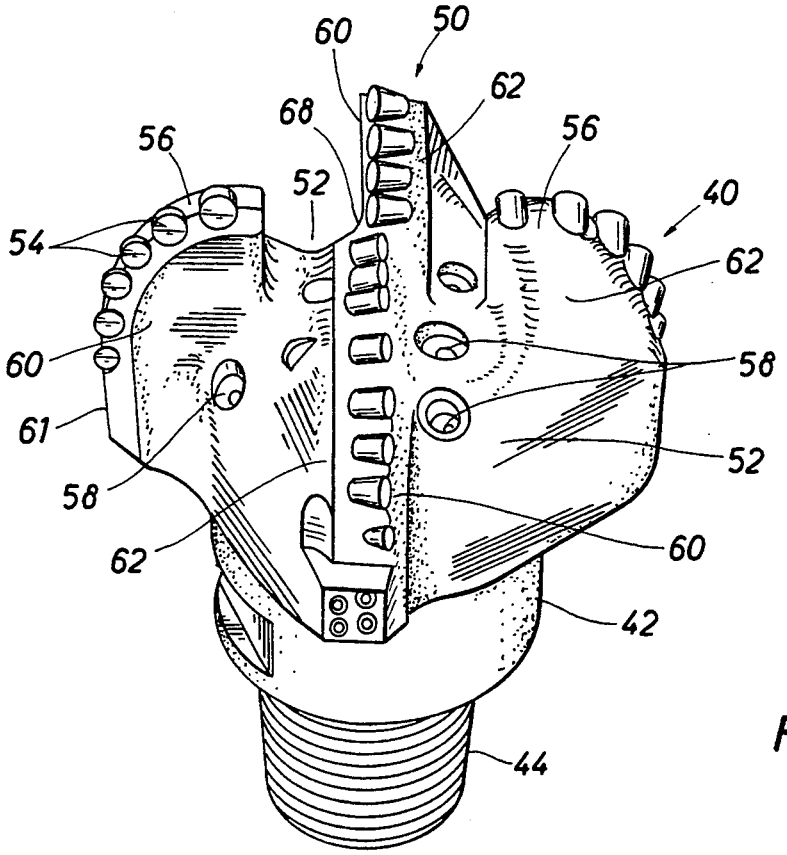
FIG. 2 is a perspective view of a preferred embodiment of the present invention illustrating the back tapered blade profile, the PDC cutter placements and the interacting nozzles or ports in the fluid channels.

With reference to the perspective view shown in FIG. 2, the drag bit of the present invention, generally designated as 40, consists of a drag bit body 42 having an opened threaded pin end 44 and an opposite cutting end generally designated as 46. The cutting end 46 comprises radially disposed lands or blades 50 forming fluid channels 52 therebetween. A plurality of PDC cutters 54 are strategically disposed on the outer surfaces 56 of the blades 50. A pair of fluid discharge nozzles or ports 58 are located in each fluid channel 52 proximate the leading vertical face 60 of each blade 50 and in specific radial positions so that the vortices formed by the fluid flow from the multiple nozzles 58 interact to create extremely turbulent fluid flow in the fluid channel 52, close to the leading face 60 of blade 50 and at and around the PDC cutters 54, this eliminates the stagnant low pressure area, as described in the prior art, at the leading blade edge 54 and prevents "bit-balling" at this critical area of the bit cutting end 46. The sloped trailing edge 62 of the blade 50 also eliminates the low pressure area at the trailing blade face 62, thereby also minimizing "bit-balling" in this critical area. The trailing sloped blade 62 also forms a fluid channel 52 having a more uniform cross-sectional area, therefore the volumetric fluid flow and velocity are more controlled to affect better cleaning and cooling of cutting end 46. The trailing sloped blade face 62 also imparts much more impact and shear strength to the blade 50 than is possible with a blade with both sides vertical. This is very beneficial when the bit cutting end 46 is fabricated from a brittle material such as tungsten carbide, rather than steel.

Figure 4:
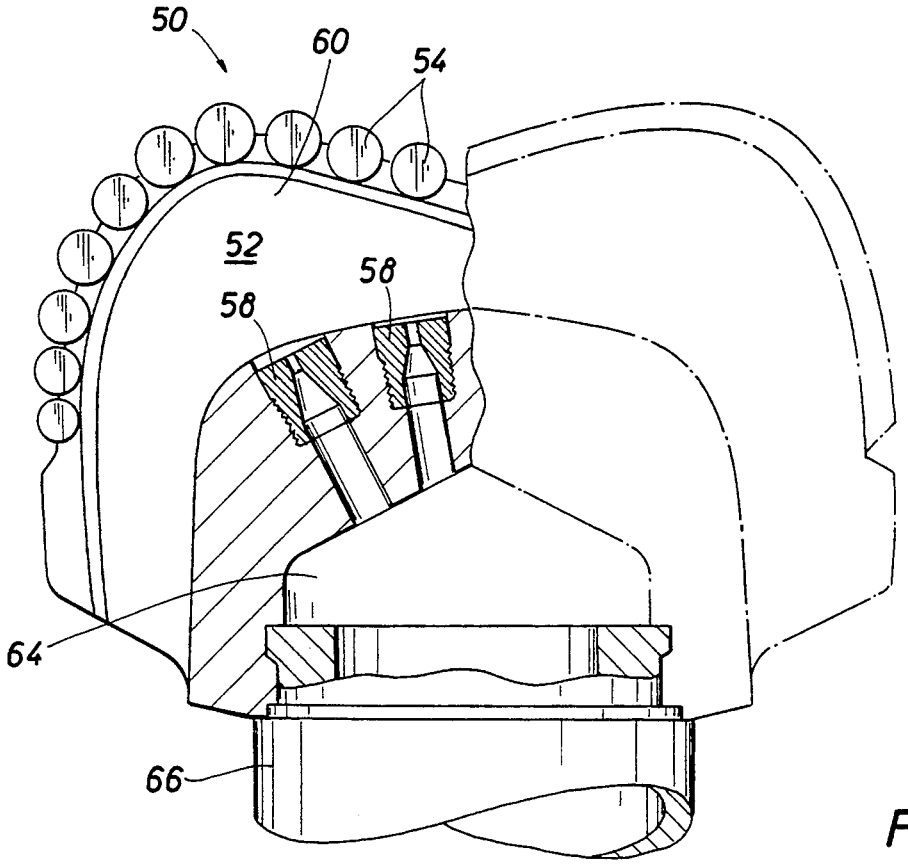
FIG. 4 is a partial vertical cross-sectional view taken through 4—4 of FIG. 3, illustrating a pair of nozzles and the leading face of a blade with the PDC cutters affixed to the outer surface of the blades.
Figure 3:
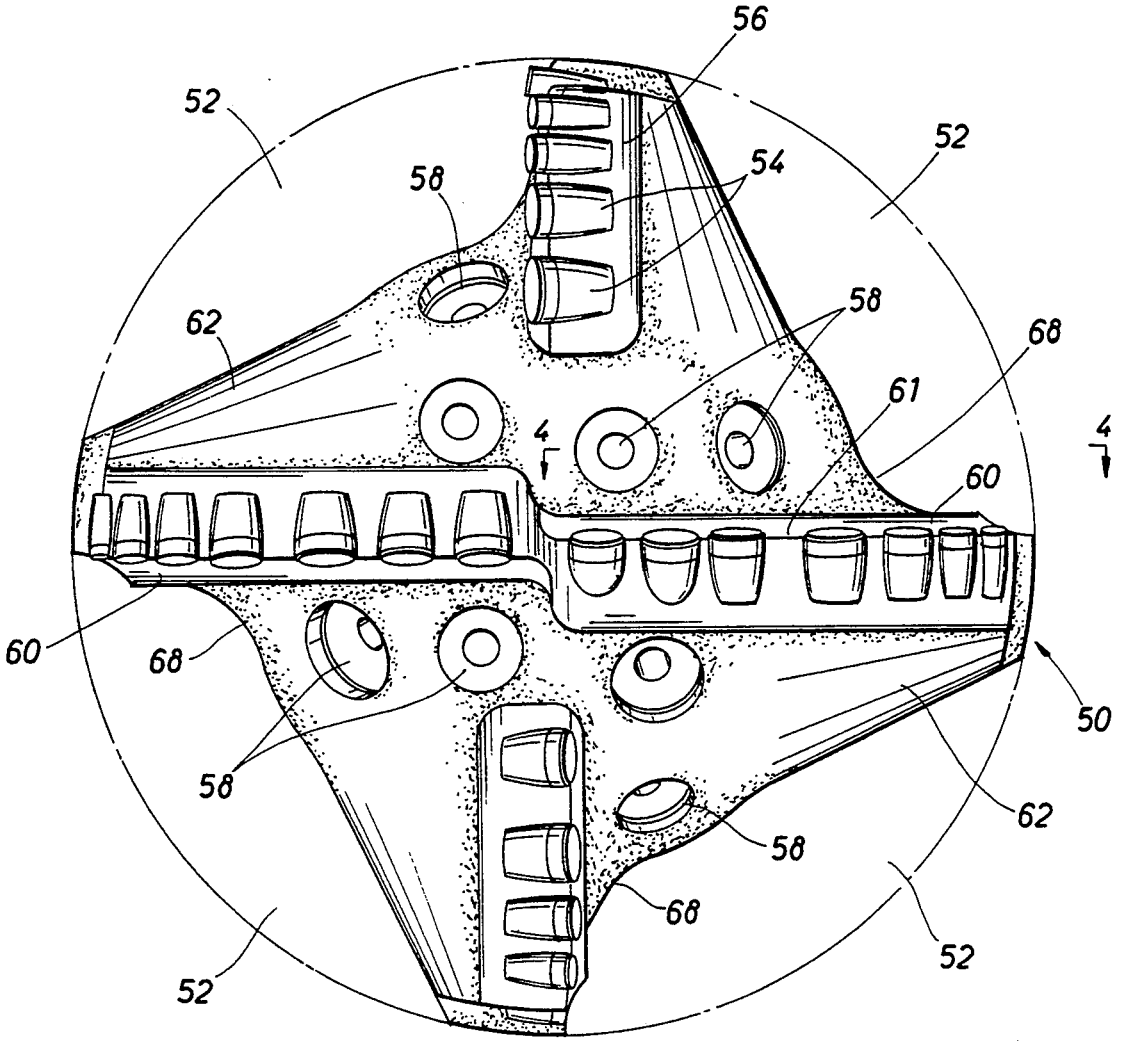
FIG. 3 is a face view of the preferred embodiment, as depicted in FIG. 2, showing the interacting nozzle placements in each fluid channel, the tapered back face of the blades and the PDC cutter placements.

FIG. 4 is a partial cross-section of the drill bit cutting end 46. Cross-section A-A of FIG. 3 is taken through the center line of two nozzles 58 which are parallel and proximate a leading vertical blade face 60. The blade 50 supports an array of PDC cutters 54 on the blade outer surface 56. The nozzles 58 are threadably retained within the bit body 42 and communicate with a fluid source plenum 64 which in turn is connected to a drill stem fluid source 66. The nozzles 58 are located at critical radial distances so that their vortices interact to create highly turbulent drilling fluid flow around the PDC cutters 54 and the vertical blade face 60. The fluid velocities that are achieved by this nozzle 58 arrangement, coupled with the more uniform fluid channel 52 cross-sectional area, are approximately a ten-fold increase over velocities observed using prior art bits. The observed laboratory exit velocities at the bit outside diameter of the present invention were in the range of 32 ft/sec to 58 ft/sec vs. 3 ft/sec to 6 ft/sec for prior art bits. All fluid velocities were directly proportional to fluid volume and affective cross-sectional area through which it was pumped.

It would be obvious to utilize multiple blades 50 and more than a pair of nozzles 58 paralleling each blade without departing from the scope of this invention.

It will of course be realized that various modifications can be made in the design and operation of the present invention without departing from the spirit thereof. Thus, while the principle preferred construction and mode of operation of the invention have been explained in what is now considered to represent its best embodiments which have been illustrated and described, it should be understood that within the scope of the appended claims, the invention may be practiced otherwise than is specifically illustrated and described.

What is claimed is:

1. A drag type drilling bit comprises;

a bit body that forms a first pin end and a second cutting end, said pin end is opened to a source of drilling fluid that is transmitted through an attachable drillstring, said pin end communicates with a fluid plenum formed by said bit body;

two or more raised blades are formed by said second cutting end and are radially disposed thereon, said blades form a first leading edge, a crest, a second tapered trailing edge and a root at the base of each blade, said second tapered trailing edge terminates substantially at the root of a following cutter blade, said first leading edge of said blade is substantially parallel with an axis formed by said body, a multiplicity of polycrystalline diamond compact elements are strategically mounted along said crest of each of said cutter blades;

drilling fluid channels are formed by said second cutting end between the blades, each channel originating proximate said axis of said body and terminates at the bit outer diameter, said second tapered trailing edge terminating at the root of a following cutter blade being adapted to create a more uniform fluid volume flow in each of said fluid channels, and two or more fluid discharge ports communicate with said fluid plenum and exit into each of said fluid channels substantially parallel and in close proximity to said first leading edge formed by said blade, the vortices created by the fluid exiting the discharge ports in each of said fluid channels inter-act to produce a highly turbulent radial flow that inhibits the accumulation of debris adjacent the cutting end of the bit while cleaning and cooling the second cutting end of the bit.

2. The invention as set forth in claim 1 wherein said two or more fluid discharge ports are strategically positioned in said channels, each of said discharge ports being proximate to and substantially parallel with said first leading edge of said raised cutter blades.

3. The invention as set forth in claim 2 wherein said discharge port retains a removable nozzle, said nozzle forming a nozzle opening designed to facilitate the particular fluid flow conditions at a borehole drilling site.

4. The invention as set forth in claim 1 wherein said drag bit contains four raised cutting blades, a second tapered trailing edge of each blade terminates substantially at the root of a following cutter blade.

5. The invention as set forth in claim 1 wherein said drag bit is fabricated from a matrix of tungsten carbide.

6. The invention as set forth in claim 1 wherein said drag bit is fabricated from steel.

* * * * *